US005906307A

United States Patent [19]

Albert et al.

[11] Patent Number: 5,906,307

[45] Date of Patent: May 25, 1999

[54] FOLDING APPARATUS SUPERSTRUCTURE WITH REPLACEABLE MANTLINGS FOR VELOCITY ADJUSTMENT

[75] Inventors: Kevin Francis Albert, Barrington; Richard Edward Breton, Rochester; Richard Lee McKrell, Rye, all of N.H.

[73] Assignees: Heidelberger Druckmaschinen AG, Heidelberg, Germany; Heidelberg Harris, Inc., Dover, N.H.

[21] Appl. No.: 08/980,139

[22] Filed: Nov. 26, 1997

Related U.S. Application Data

[63] Continuation of application No. 08/460,911, Jun. 5, 1995, abandoned.

[51] Int. Cl.[6] ..... B65H 20/24

[52] U.S. Cl. ..... 226/109; 226/175; 226/190

[58] Field of Search ..... 226/109, 111, 226/175, 189, 190, 191; 101/415.1

[56] References Cited

U.S. PATENT DOCUMENTS

| | | | |
|---|---|---|---|
| 3,930,602 | 1/1976 | Vorobiev et al. | 226/109 |
| 4,049,168 | 9/1977 | Cole et al. | 226/109 |
| 4,218,945 | 8/1980 | Sharlow | 226/109 |
| 4,289,489 | 9/1981 | Moschetto | 226/175 |
| 4,378,737 | 4/1983 | Kirkpatrick . | |
| 4,466,576 | 8/1984 | Simson | 226/175 |
| 4,671,501 | 6/1987 | Fujishiro . | |
| 5,127,323 | 7/1992 | Lindblom . | |
| 5,178,313 | 1/1993 | LeCompte et al. | 226/190 |

FOREIGN PATENT DOCUMENTS

| | | | |
|---|---|---|---|
| 0502942 | 5/1954 | Canada | 226/190 |
| 0672655 | 10/1963 | Canada | 226/190 |
| 0052059 | 4/1943 | France | 226/109 |
| 1038033 | 9/1953 | France | 226/109 |
| 40 26 238 C1 | 12/1991 | Germany . | |
| 0051178 | 4/1979 | Japan | 226/190 |
| 3026644 | 2/1991 | Japan | 226/109 |

OTHER PUBLICATIONS

Netherlands Patent No. 89,136, Apr. 15, 1958.

*Primary Examiner*—Charles A. Marmor
*Assistant Examiner*—Matthew A. Kaness
*Attorney, Agent, or Firm*—Kenyon & Kenyon

[57] ABSTRACT

A superstructure of a folding apparatus for feeding at least two webs of flat material to a cylinder unit of the folding apparatus. The superstructure including at least two take-off roller assemblies, each take-off roller assembly including a corresponding take-off roller rotatably mounted on the superstructure. At least one mantling is provided for mounting on an outer surface of each take-off roller in order to adjust a diameter of the corresponding take-off roller assembly. A drive assembly is provided for driving the at least two take-off roller assemblies, each of the at least two take-off roller assemblies having a respective circumferential velocity which is a function of the adjusted diameter of the take-off roller assembly.

7 Claims, 6 Drawing Sheets

FOLDING APPARATUS SUPERSTRUCTURE WITH REPLACEABLE MANTLINGS FOR VELOCITY ADJUSTMENT

This application is a continuation of application Ser. No. 08/460,911, filed on Jun. 5, 1995, now abandoned.

FIELD OF THE INVENTION

The present invention relates to a superstructure of a folding apparatus.

BACKGROUND OF THE INVENTION

Folding apparatuses are used in conjunction with rotary printing presses in order to fold webs (or ribbons) of printed material. Generally, a full width web of material is cut longitudinally into a number of ribbons by a slitter mechanism prior to folding in the folder apparatus. However, for purposes of this application, the term web encompasses the term ribbon as well.

A folding apparatus is generally coupled to one or more rotary printing presses. Each folding apparatus generally includes a superstructure through which two or more webs of flat printed material are passed before they reach a cylinder unit of the folding apparatus. The superstructure includes a take-off roller corresponding to each web for driving the webs into the cylinders of the folding apparatus. A problem which frequently arises is that the circumferential velocities at which the various take-off rollers must be driven are often different from one another.

Varying circumferential velocities are necessary in order to achieve an identical transport speed of the various webs. For example, it may be necessary to ensure that a predetermined position on the imprint of one web arrives at a cutting device at the same time that the imprint of another web arrives at that cutting device. The necessity for different circumferential velocities of the take-off rollers results, for example, from the different web lengths within a turning rod section of the folder or between a turning rod and a related take-off roller, and from the different tension conditions of the various webs which result from this.

The necessity for different circumferential velocities also results from the so-called radius effect, which occurs if several webs are passed over a single roller, i.e. one above the other. In this case, the webs which are passed over the outside of the roller (e.g. the outermost web) are pulled off more rapidly than the ones which pass over the inside of the roller (i.e. the web which directly contacts the roller), because of their greater distance from the center of the roller. If the webs which are passed further to the outside are now passed to the inside on a subsequent roller, in other words at a slower web velocity in comparison with the preceding roller, wrinkles and other undesirable irregularities of the web product can occur. In order to compensate for such radius effects, the circumferential speed of the subsequent roller is increased by utilizing complicated control mechanisms.

In addition to the technical effort of providing a separate control for each drive roller of a large drive roller assembly, adjustment and monitoring of the circumferential velocity of a large number of rollers can easily overburden the operating personnel. While it is possible to use step-down gears, or separate drives which allow precise velocity adjustment, these devices are cost-intensive and require careful installation. Such devices can also reduce the operational reliability of the system because they have a tendency to break-down.

SUMMARY OF THE INVENTION

In accordance with the present invention, a mantling is provided which can be removably mounted around a take-off roller(s) to adjust the diameter, and therefore the circumferential velocity, of the take-off roller(s). The mantling is fixedly mounted on the take-off roller so that it rotates with it. By mounting mantlings with different wall thickness around the outside surface of the take-off roller, the diameter of the take-off roller and thus the circumferential or take-off velocity of the take-off roller can be adjusted. This makes it possible to take different tension conditions of the various webs into consideration and thus to achieve a predetermined take-off or transport velocity for all of the webs.

In accordance with a first embodiment of the present invention, the mantling is formed in the shape of a sleeve which can be mounted axially on the take-off rollers by pushing the sleeve over the take-off rollers. Such a mantling provides a predetermined take-off velocity which corresponds to the wall thickness of the sleeve. Moreover, a mantling formed as a sleeve can be easily mounted on the take-off roller in a very short period of time, without requiring complicated adjustment or assembly steps.

Since the take-off speed of the web is extremely sensitive to changes in the circumference of the take-off rollers, the wall thicknesses of the mantlings are preferably small. As a result, for a take-off roller having a radius between 3 inches and 8 inches, the wall thickness of the mantlings preferably lies between 20 $\mu$m and 150 $\mu$m.

The change in velocity ($^{\Delta}V_s$) of the surface of the take-off roller, as a function of the wall thickness (t) of the sleeve, is governed by the following equation:

$$^{\Delta}V_s = V_i t / R_i \tag{1}$$

Where $^{\Delta}V_s$ is the change in surface velocity due to the addition of the sleeve, $V_i$ is the surface velocity without the sleeve, t is the thickness of the sleeve, and $R_i$ is the radius of the take-off roller without the sleeve.

In accordance with a second embodiment of the present invention, the mantling is formed as a plate which is attached to the outside surface of the roller in the same manner that a printing plate is mounted to a plate cylinder; i.e. by using clamps to hold each end of the plate onto the roller. The relationship between the thickness of the plate and the change in take-off velocity can be obtained as described above with regard to the first embodiment.

In accordance with a third embodiment of the present invention, mantlings of varying wall thicknesses are provided to adjust the diameters of various rollers. In this manner, the circumferential velocities of the take-off rollers can be adjusted to one of a variety of velocities within a very short period of time. This is particularly advantageous in view of the need to keep the down-time of the rotary printing press and folding apparatus low.

In a accordance with a still further embodiment of the present invention, the sleeve is pushed onto a roller utilizing compressed air. By applying compressed air through apertures in the surface of the take-off roller, the sleeve is expanded slightly and can be pushed onto the take-roller without resistance. Once the sleeve has been brought into the desired position, the compressed air is shut off, the sleeve compresses and is fixed around the outside surface of the take-off roller. In this manner, installation of the mantling onto the take-off roller is accomplished easily and without the need for clamps.

In accordance with a still further embodiment of the present invention, in order to prevent damage to the web as it passes over the sleeve, and particularly to prevent ink from being removed from a printed surface of the web, the mantling may include a carrier which can be applied to the outside surface of the roller, with a resilient coating applied to the outside surface of the carrier. The carrier preferably consists of metal or plastic. The coating is preferably a rubber elastic material. The carrier is applied as a layer to the outside of the sleeve.

DETAILED DESCRIPTION OF THE INVENTION

Figure 1:
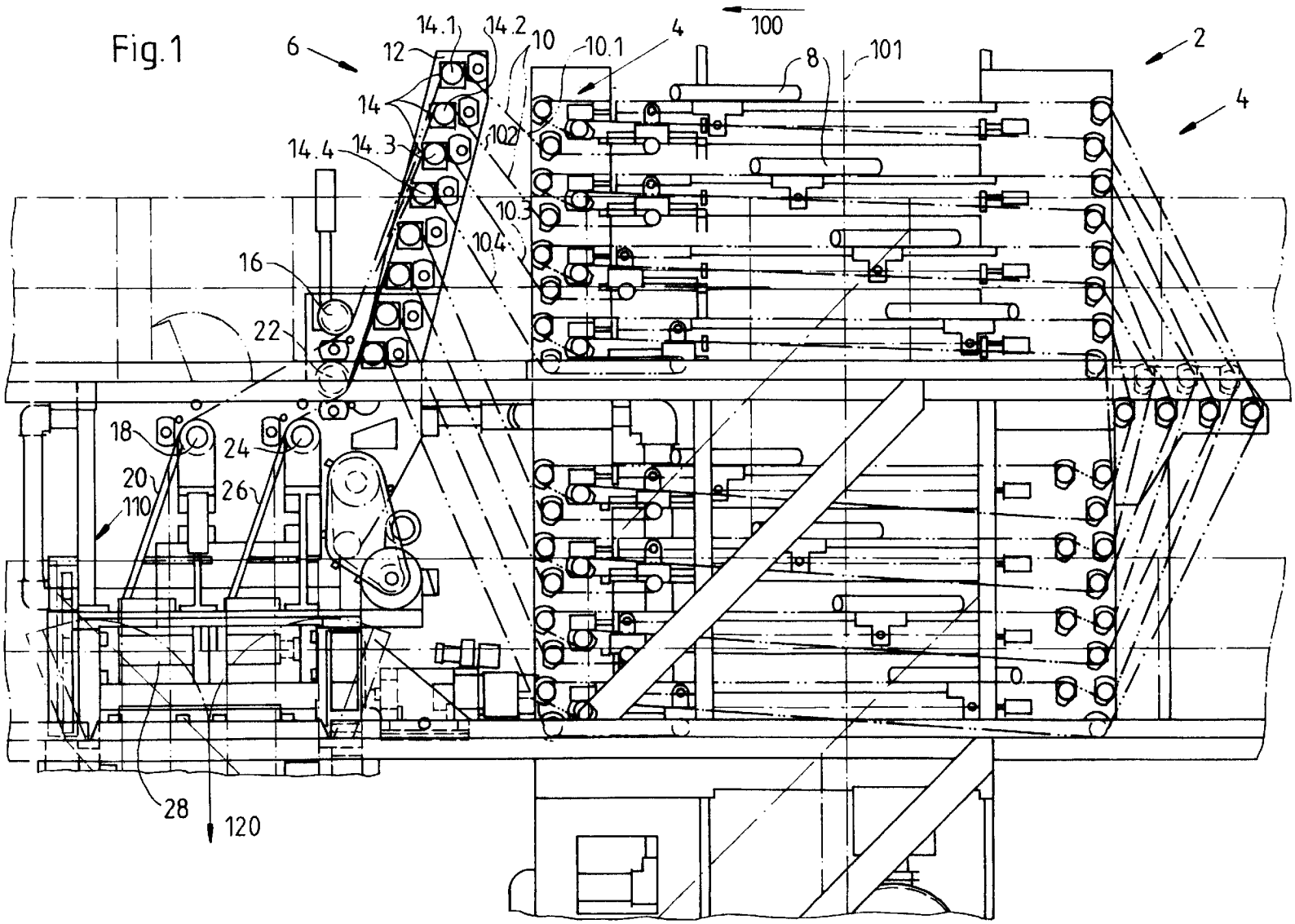
FIG. 1 shows a side view of a superstructure of a folding apparatus according to an embodiment of the present invention.

FIG. 1 shows a superstructure 2 of a folding apparatus which is coupled to a rotary printing press (not shown). Referring to FIG. 1, the rotary printing press is located behind the superstructure 2, and is aligned along the press centerline 101 such that the web is traveling towards the reader as it exits the rotary printing press. The superstructure 2 includes an intake area 4, also called an angle bar section, and a drive area 6. As webs 10 exit the rotary printing press, they are received at the superstructure 2 and are introduced into the intake area 4 via turning bars 8. From the intake area 4, the webs 10 are guided to the drive area 6, where they first pass onto take-off roller assemblies 14 which are mounted in a take-off roller carrier 12. The take-off roller assemblies 14 are driven by a drive assembly (not shown). In the transport direction 100, webs 10.1, 10.2, 10.3, and 10.4, pass through take-off roller assemblies 14.1, 14.2, 14.3, 14.4 arranged in the upper part of the take-off roller carrier 12. Webs 10.1–10.4 are then guided, as a first layered web, over a first collection roll 16 and a first funnel intake roller 18, into a first folding funnel 20 (following transport direction 110), where the first layered web, which includes webs 10.1–10.4, receives a first lengthwise fold. The other webs 10 which are passed over four take-off roller assemblies 14 arranged in the lower part of the take-off roller carrier 12 are similarly guided as a second layered web over a second collection roll 22 and then over a second funnel intake roller 24, into a second folding funnel 26 following transport direction 110. Below the two folding funnels 20, 26 is a cylinder unit of the folding apparatus, of which only a cutting cylinder 28 is shown. The cutting cylinder 28 cuts the layered webs which have previously been provided with a first lengthwise fold in the first and second folding funnels 20, 26, in a direction perpendicular to the transport direction 120.

Figure 2:
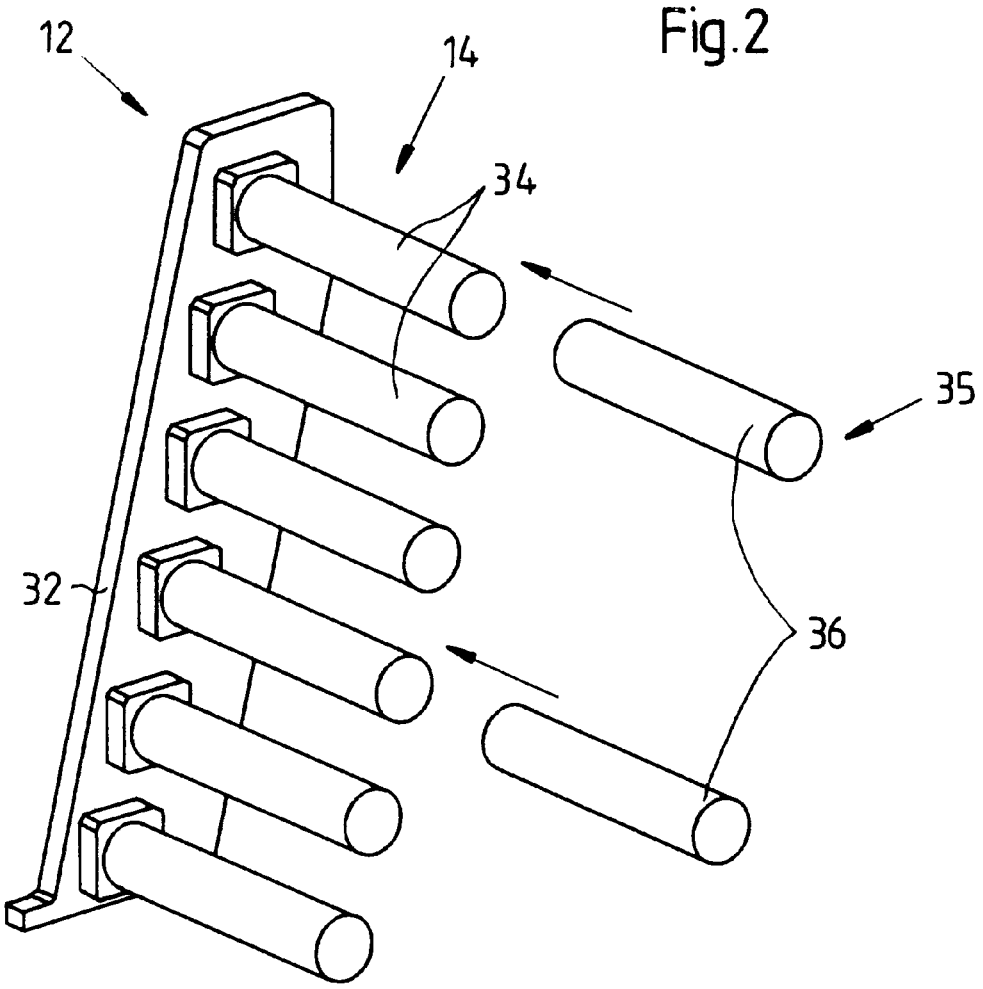
FIG. 2 shows a more detailed view of a take-off roller carrier and take-off roller assemblies of the superstructure shown in FIG. 1.

FIG. 2 shows the take-off roller carrier 12 and the take-off roller assemblies 14 of FIG. 1 in more detail. The take-off roller carrier 12 includes a carrier strut 32 and the take-off roller assemblies 14 include take-off rollers 34 which are mounted so they can be driven by a drive assembly (not shown). The take-off rollers 14 may further include mantlings 35 which are provided in the form of sleeves 36 with different wall thicknesses. The sleeves 36 can be pushed onto the take-off rollers 34 in order to adjust the diameter of the take-off rollers 14. Sprockets 44 are mounted to each take-off roller 34. For purposes of illustration, only two representative sprockets 44 are shown.

Figure 3:
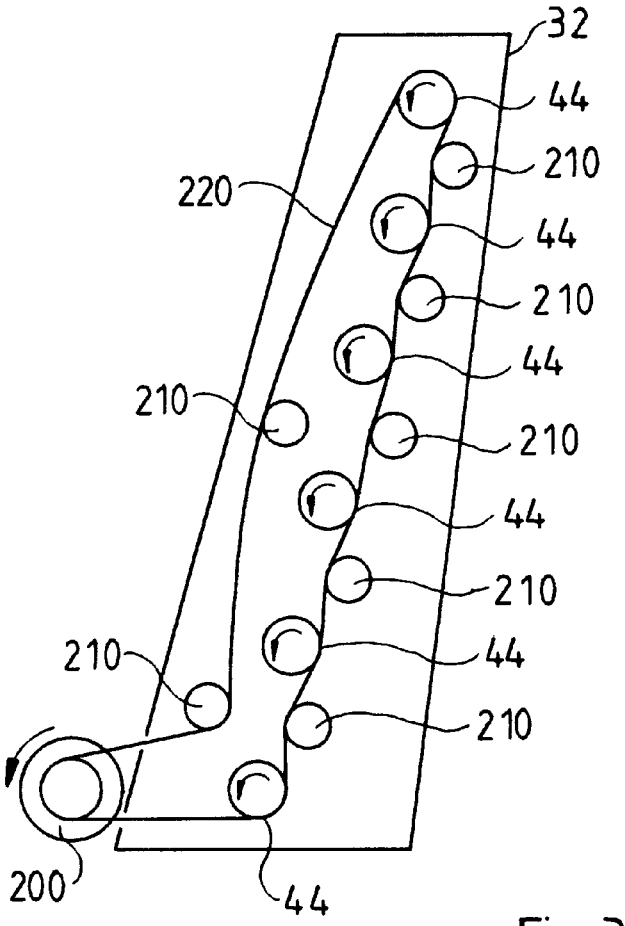
FIG. 3 shows an illustrative drive assembly for the take-off roller carrier and take-off roller assemblies of FIG. 2.

FIG. 3 shows an illustrative drive assembly for the take-off rollers 34. A common belt 220 (or chain) is engaged with each sprocket 44 and wrapped around a drive gear 200. Rollers 210 are used to keep the belt 220 in engagement. A motor (not shown) drives the drive gear 200.

In this manner, take-off rollers 34 which are driven by a common belt drive with an identical angular velocity can nevertheless exhibit different circumferential speeds by providing different take-off rollers 34 with push-on sleeves 36 with different wall thicknesses.

As set forth above, the change in velocity ($^{\Delta}V_s$) of the surface of the take-off roller 34, as a function of the wall thickness (t) of the sleeve 36, is $^{\Delta}V_s = V_i\, t/R_i$, where $V_i$ is the surface velocity without the sleeve and $R_i$ is the radius of the take-off roller without the sleeve. By choosing sleeves 36 with appropriate wall thicknesses, different take-off rollers 34 can exhibit different circumferential speeds while being driven at the same velocity by a common belt drive. As a result, radius effects, or other tension conditions existing on the material webs 10 which pass over the take-off rollers 34, can be compensated for.

Moreover, since the sleeves 36 can be easily removed and replaced, the circumferential speed of any take-off roller can be quickly and easily adjusted at any time. Since the path of the webs 10 through the folding apparatus superstructure will generally vary according to the requirements of the print job being run at any given time (e.g. number of pages, size of pages, size of signatures), quick adjustment of the circumferential speeds of the take-off rollers is extremely beneficial.

Figure 4:
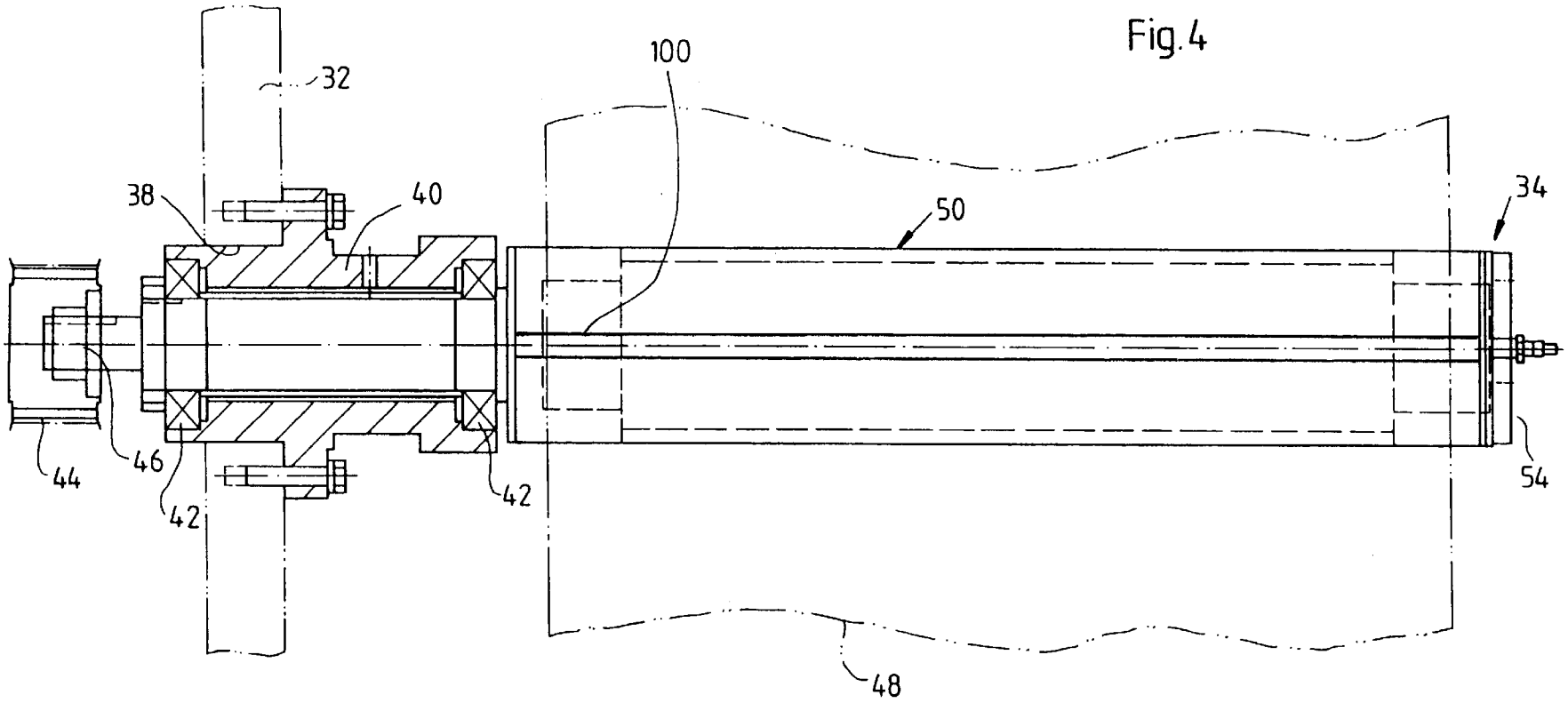
FIG. 4 shows a cross-section through a take-off roller of the take-off roller assembly shown in FIG. 2.

FIG. 4 shows a cross-section through a take-off roller 34 of FIG. 2 mounted on the carrier strut 32. The take-off roller 34 rotates within a bearing housing 40, the bearing housing 40 having two deep groove ball bearings 42 mounted therein. The bearing housing 40 is mounted within an opening 38 of the carrier strut 32, and is fastened to the carrier strut 32 via screws 52. The take-off roller 34 extends through the carrier strut 32, i.e. through the bearing housing 40, and has sprocket 44 (which may be formed as a toothed pulley) on its drive side end 46. The belt 45 (not shown) is engaged with the pulley 44 and drive gear 200 (not shown) to drive the take-off roller 34.

A mantling 48, shown in the form of the partially interrupted line, is applied to the outside surface 50 of the take-off roller 34.

Figure 5:
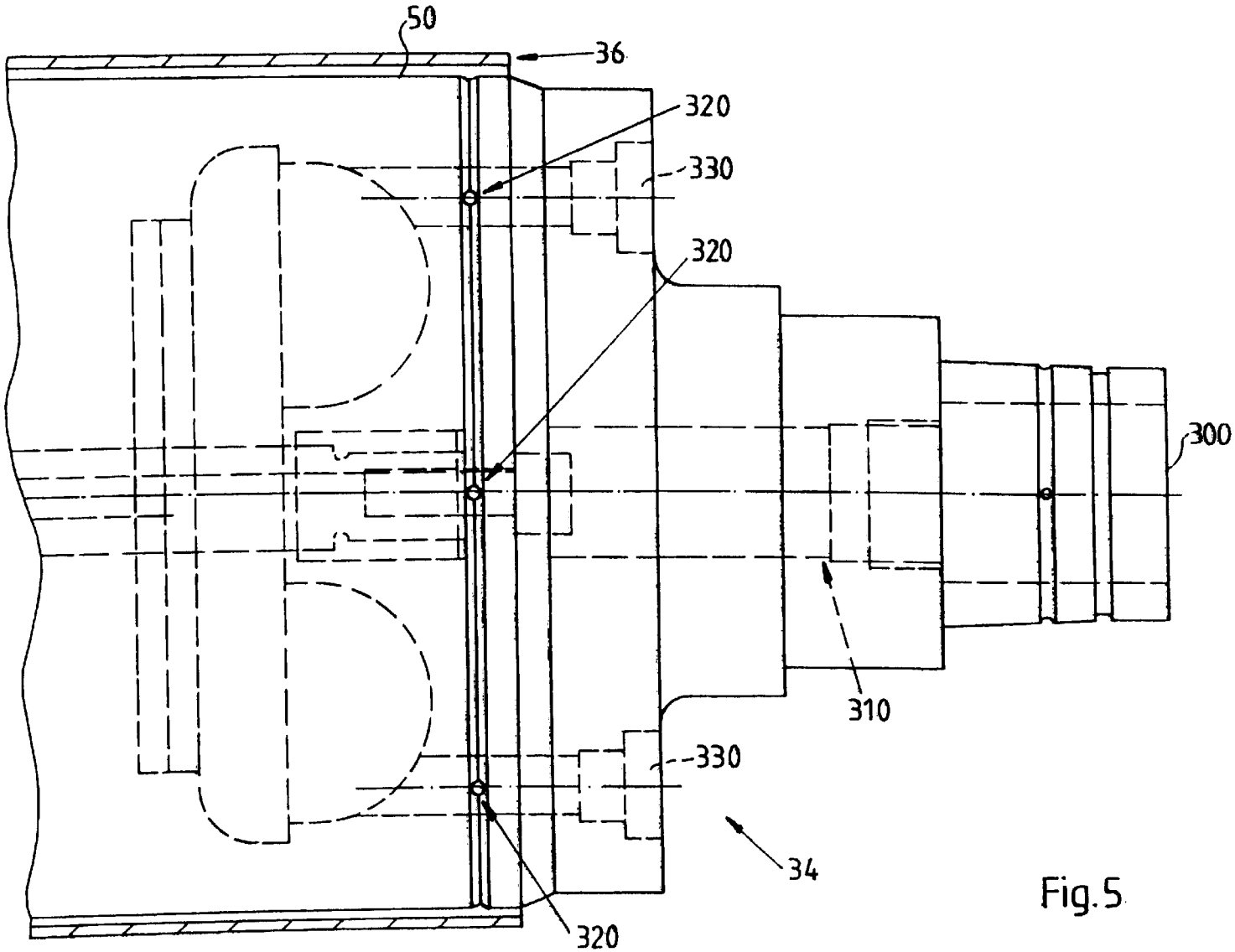
FIG. 5 shows a take-off roller and sleeve shaped mantling the take-off roller having a compressed air port.
Figure 5A:
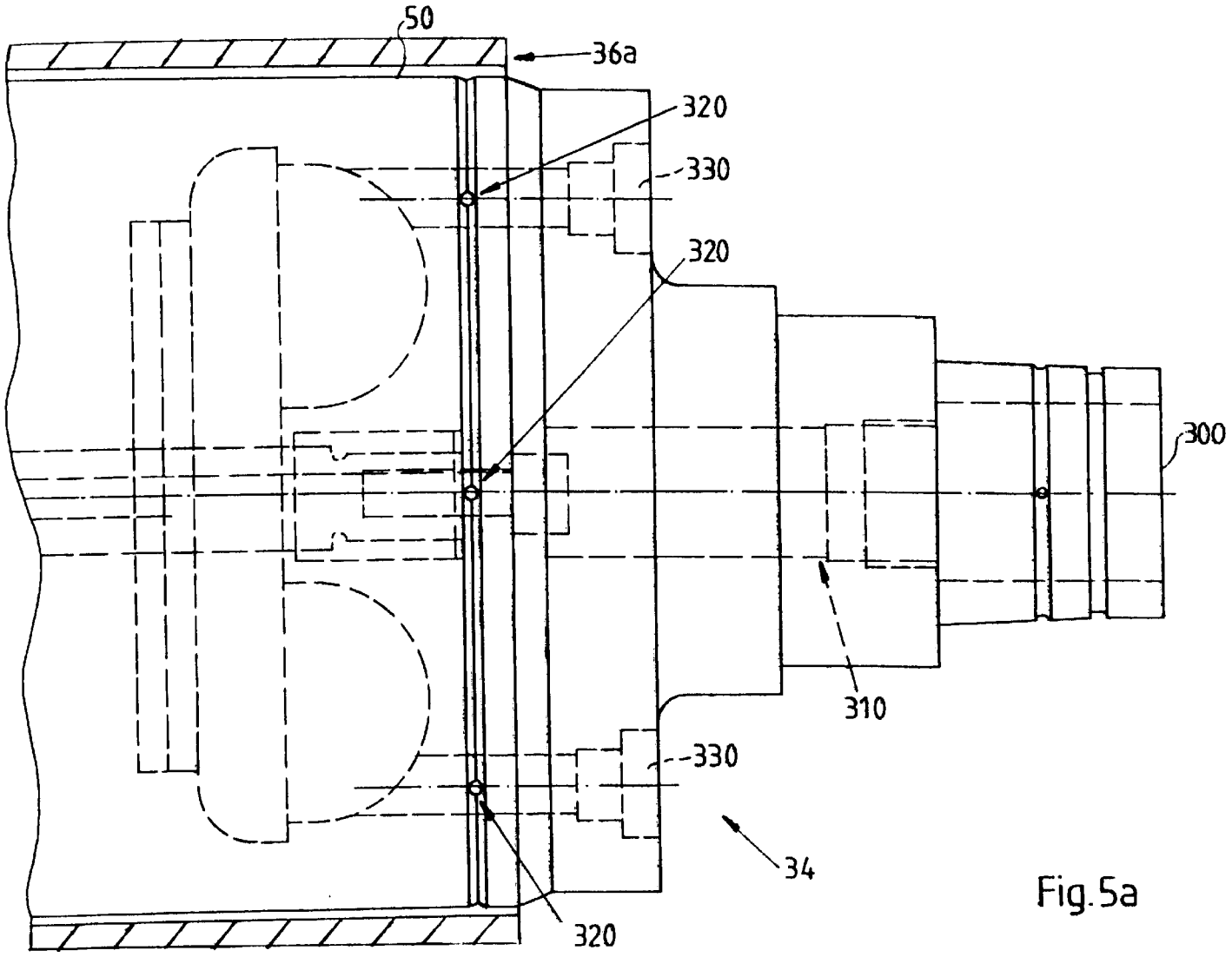
FIG. 5*a* shows the take-off roller of FIG. 5, but with a sleeve-shaped mantling of a different thickness.

If the mantling 48 is formed as a sleeve 36, it is mounted axially over the surface 50 of the take-off roller 34 from the right side 54 of the take-off roller 34. Referring to FIG. 5, compressed air is applied to an opening 300 in the take-off roller 34. The compressed air travels though a passage 310 in the interior of the take-off roller 34, and escapes though apertures 320 on the surface 50 of the take-off roller 34. Plugs 330 are provided for ease of manufacture. As the sleeve 36 is mounted axially from the right side 54 of the take-off roller, the sleeve 36 is expanded by air pressure, and the sleeve 36 is easily slid over the length of the take-off roller. Once the sleeve is in place, the compressed air is removed, the sleeve contracts, and a friction fit between the take-off roller 34 and the sleeve 36 is formed. FIG. 5*a* shows a sleeve 36*a* of a different thickness than the sleeve 36 in FIG. 5.

If the mantling 48 is formed as a plate, it is wrapped around the surface 50 of the take-off roller 34 and clamped. Such clamping can be accomplished in any conventional manner. For, example, clamping mechanisms 100 (shown schematically in FIG. 4) such as those used for printing plates can be used, including the mechanism disclosed in U.S. Pat. No. 5,284,093 to Guaraldi et al, the specification of which is hereby incorporated by reference. As with the sleeve shaped mantlings, plate shaped mantlings may be provided in a variety of thicknesses, and be installed and removed as appropriate in order to adjust the circumferential speed of the take-off rollers 34. The change in velocity ($^{\Delta}V_s$) of the surface of the take-off roller 34, as a function of the thickness (t) of the plate shaped mantling, is $^{\Delta}{}_{Vs}=V_i\ t/R_i$, where $V_i$ is the surface velocity without the mantling and $R_i$ is the radius of the take-off roller without the mantling.

Figure 6:
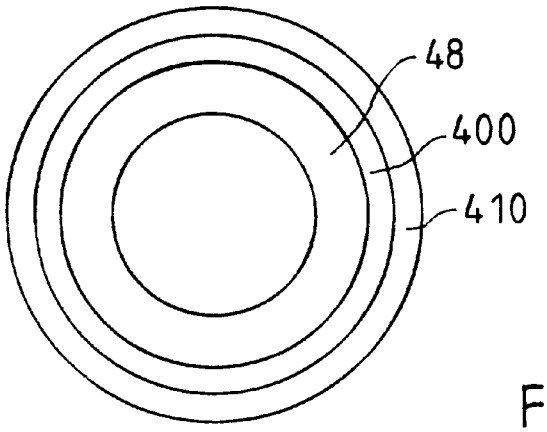
FIG. 6 shows a mantling according to FIG. 4 having a carrier and resilient coating applied thereto.

Referring to FIG. 6, in accordance with a further embodiment of the present invention, a carrier 400 is applied to the surface 50 of the mantling 48, and a resilient coating 410 is applied to an outside surface 420 of the carrier 400. The carrier 400 is preferably made of metal or plastic. The resilient coating 410 is preferably an elastomeric material such as rubber. The addition of the carrier 400 and coating 410 prevents the ribbon 10 from being damaged as it passes over the mantling, and, in addition, prevents ink from being removed from the surface of the ribbon 10 as it passes over the mantling 48. While the carrier 400 and coating 410 have been shown as applied to a sleeve shaped mantling, it should be understood that the carrier 400 and coating 410 can be applied to a mantling 48 formed as a plate as well.

What is claimed is:

1. A superstructure of a folding apparatus, the superstructure comprising at least two take-off roller assemblies, each take-off roller assembly including a corresponding take-off roller rotatably mounted on the superstructure;

a corresponding mantling for mounting on an outer surface of the take-off roller in order to adjust a diameter of the corresponding take-off roller assembly;

a drive assembly for driving the at least two take-off roller assemblies, each of the at least two take-off roller assemblies having a respective circumferential velocity which is a function of the adjusted diameter of the take-off roller assembly.

2. The superstructure according to claim 1, wherein the mantling is formed as a sleeve.

3. The superstructure according to claim 1, wherein the mantling is formed as a plate, the plate being removably clamped to the take-off roller.

4. The superstructure according to claim 1, wherein the mantling is formed as a sleeve, the sleeve being axially mounted on and dismounted from the take-off roller.

5. The superstructure according to claim 4, wherein the outer surface of the take-off roller comprises a source of pressure, the sleeve being expanded by pressure transmitted from the outer surface of the take-off roller, the sleeve being fixedly mounted onto the take-off roller by releasing the pressure.

6. The superstructure according to claim 1, wherein each take-off roller being adapted to have mounted thereon one of a plurality of mantlings of different wall thicknesses, each of the one of the plurality of mantlings mounted on each of the take-off rollers adjusting the diameter of the take-off roller assemblies.

7. The superstructure according to claim 1, wherein the mantling further comprises a carrier applied to an outside surface of the mantling, a resilient coating being applied to an outside surface of the carrier.

* * * * *